US006469435B1

(12) United States Patent
Seibold et al.

(10) Patent No.: US 6,469,435 B1
(45) Date of Patent: Oct. 22, 2002

(54) DISCHARGE LAMP WITH DIELECTRICALLY IMPEDED ELECTRODES

(75) Inventors: Michael Seibold, Munich; Michael Ilmer; Angela Eberhardt, both of Augsburg, all of (DE)

(73) Assignee: Patent-Treuhand-Gesellschaft fuer Elektrische Gluehlampen mbH, Munich (DE)

( * ) Notice: Subject to any disclaimer, the term of this patent is extended or adjusted under 35 U.S.C. 154(b) by 0 days.

(21) Appl. No.: 09/463,904

(22) PCT Filed: May 11, 1999

(86) PCT No.: PCT/DE99/01421

§ 371 (c)(1),
(2), (4) Date: Feb. 2, 2000

(87) PCT Pub. No.: WO99/66537

PCT Pub. Date: Dec. 23, 1999

(30) Foreign Application Priority Data

Jun. 16, 1998 (DE) ..... 198 26 808

(51) Int. Cl.[7] ..... H01J 1/62

(52) U.S. Cl. ..... 313/493; 313/494; 313/635; 501/77

(58) Field of Search ..... 313/428, 570, 313/494, 621, 635, 631, 477 R; 501/77

(56) References Cited

U.S. PATENT DOCUMENTS 3,645,761 A * 2/1972 Kawamura et al. ..... 106/53
3,778,242 A 12/1973 Francel et al.
5,214,350 A * 5/1993 Remec et al.
6,060,828 A * 5/2000 Vollkommer et al. ..... 313/631

FOREIGN PATENT DOCUMENTS

WO 9423442 10/1994

* cited by examiner

*Primary Examiner*—Sandra O'Shea
*Assistant Examiner*—Guiyoung Lee
(74) *Attorney, Agent, or Firm*—Robert F. Clark

(57) ABSTRACT

A discharge lamp, suitable for operation by means of dielectrically impeded discharge, having electrodes arranged on the wall of the discharge vessel, has at least one dielectric layer which covers at least a part of the electrodes and, optionally, the discharge vessel wall as well. A phosphor and/or reflective layer is arranged on the at least one dielectric layer. According to the invention, at least the dielectric layer arranged directly underneath the phosphor or reflective layer consists of a glass solder whose viscosity variation as a function of temperature is irreversible, in particular of a sintered glass ceramic. This prevents this layer from re-melting during the fabrication process and thereby tearing the overlying porous reflective and/or phosphor layers.

5 Claims, 2 Drawing Sheets

DISCHARGE LAMP WITH DIELECTRICALLY IMPEDED ELECTRODES

TECHNICAL FIELD

The invention relates to a discharge lamp according to the precharacterizing clause of claim 1.

The term "discharge lamp" here covers sources of electromagnetic radiation based on gas discharges. The spectrum of the radiation can in this case cover both the visible range and the UV (ultraviolet)/VUV (vacuum ultraviolet) range, as well as the IR (infrared) range. Furthermore, a phosphor layer may also be provided for converting invisible radiation into visible radiation.

The case in point deals with discharge lamps having so-called dielectrically impededed electrodes. The dielectrically impeded electrodes are typically produced in the form of thin metal strips, at least a part of which is arranged on the inner wall of the discharge vessel. At least a part of these inner-wall electrodes is fully concealed from the interior of the discharge vessel by a dielectric barrier layer.

If only electrodes of a single polarity—preferably the anodes—are covered with a dielectric barrier layer, then in preferable unipolar operation a so-called unilaterally dielectrically impeded discharge is formed. However, if all the electrodes, i.e. both polarities, are covered with a dielectric barrier layer, then both in unipolar and bipolar operation a bilaterally dielectrically impeded discharge is formed.

On the dielectric barrier layer, and in general on all other parts of the inner wall of the discharge vessel as well, at least one other functional layer is applied, e.g. a layer of a phosphor or phosphor blend and/or one or more layers which reflect visible radiation (light) and/or UV radiation. The purpose of the reflective layer is to send out visible light in a controlled way, i.e. only in a particular preferred direction of the lamp.

There are no particular restrictions on the geometrical shape of the discharge vessel. For example, tubular or flat discharge vessels are commonplace, the latter being amongst other things suitable as so-called flat lamps for the back-lighting of liquid crystal displays (LCDs).

PRIOR ART

The starting materials for both the reflective and the phosphor layer or layers are initially in the form of powders with a suitable grain size. These powders are then applied as a suspension, usually mixed with an organic binder, with a defined layer thickness to the inner wall of the lamp or to the previously applied other functional layers, e.g. electrodes and dielectric barrier layer. The thickness of the reflective or phosphor layer is, controlled through the viscosity of the suspension, adapted to the respective coating process. After drying and heating, the reflective and/or phosphor layers are in the form of porous powder layer or layers.

Besides the phosphor layer thickness, the uniformity of the reflective and/or phosphor layer as well as its mechanical bonding strength, which decreases as the layer thickness increases, are also important conditions for obtaining optimum conversion of UV light to visible light.

The dielectric barrier layer usually consists of glass frits, preferably lead borosilicate glass (Pb—B—Si—O).

In the case of flat lamps, whose discharge vessels respectively consist of an essentially plane base glass, a similar front glass and, optionally, a frame, the base glass is provided with a so-called solder edge which likewise consists of a glass frit, preferably PbB—Si—O. The purpose of this solder edge is to bond the components of the discharge vessel (base glass, frame, front glass) in vacuum-tight fashion during the assembly process. This assembly process involves carrying out a thermal treatment in which the solder edge "melts" to a defined degree, i.e. reaches a defined viscosity.

The reflective and/or phosphor layers are usually applied before this assembly process. Because of this, in addition to the solder edge, the dielectric barrier layer also returns to lower viscosity at the assembly temperature. The overlying porous reflective and/or phosphor layers are hence in turn torn by the "movement" in the dielectric barrier layer ("ice-floe formation"). The reason for this is that the porous layers have no cohesion and hence cannot join in with this movement without damage, but instead tear and/or even sink partly into the dielectric barrier layer. The uniformity of the reflective and phosphor layer is hence compromised, which causes light losses. Furthermore, these "ice floes" are clearly identifiable during lamp operation as light-density non-uniformity, for example on the luminous side of a flat lamp.

DESCRIPTION OF THE INVENTION

The object of the present invention is to avoid the disadvantages mentioned above and to provide a discharge lamp according to the precharacterizing cause of claim 1 which has a phosphor and/or reflective layer improved in terms of homogeneity.

This object is achieved by the characterizing features of claim 1. Particularly advantageous refinements are described in the dependent claims.

According to the invention, that layer which is arranged essentially directly underneath the phosphor or reflective layer of the discharge lamp consists of a glass solder whose viscosity variation as a function of temperature is irreversible. This feature is described in more detail below. For the sake of simplicity, this layer will also be referred to below as the "supporting" layer or "anti-ice-floe layer".

In this context, essentially directly underneath the phosphor or reflective layer of the discharge lamp means that as far as possible there should be no other layer between the "supporting" layer and the porous phosphor or reflective layer, or at most only a very thin one. The maximum allowable thickness for such an additional layer is dictated by the condition that, when the lamp is heated (heating up, assembly process etc.) the porous phosphor or reflective layer arranged directly above must not be able to tear as a result of excessive "movement" because of the softening of the additional layer. Depending on its make-up and composition, the thickness of any additional layer should not exceed 100 $\mu$m, preferably 50 $\mu$m, typically 10 $\mu$m, ideally 5 $\mu$m. The "supporting" layer is, however, preferably arranged directly underneath the phosphor or reflective layer, i.e. without any additional layer between the "supporting" layer and the phosphor or reflective layer.

This "supporting" layer ("anti-ice-floe layer") may be formed either by the actual barrier layer acting as a dielectric impediment for the discharge, or by an interlayer arranged between the dielectric barrier layer, on the one hand, and the reflective and/or phosphor layer, on the other.

This interlayer should cover at least all of the dielectric barrier layer, and may even be applied "full-surface". For the effect according to the invention, it has been found to be sufficient if the thickness of this "supporting" interlayer is of the order of about 10 $\mu$m or more. The system, typically in paste form, is applied using standard methods such as spraying, dispensing, roller application, screen or stencil printing, etc.

The dielectric barrier layer can be applied both in strip form to the individual electrodes (for unilateral and bilateral dielectric impediment) and—in the case of bilaterally dielectrically impeded discharge—"full-surface" by means of a single continuous barrier layer which covers all of the inner-wall electrodes. The selection of the suitable thickness for the barrier layer is essentially dictated by physical discharge requirements and is typically of the order of 10 $\mu$m to several hundred $\mu$m, in particular between 50 $\mu$m and 200 the $\mu$m, typically between 80 $\mu$m and 180 $\mu$m. Furthermore—in the case of bilaterally dielectrically impeded discharge—the thickness of the barrier layer(s) for the anodes or cathodes may also be chosen to be different. Preferably, in unipolar pulse operation (W094/23442), the barrier layer for the anodes is thicker than that for the cathodes, although the layer thicknesses may also be equal.

The advantage of the first solution, i.e. the dielectric barrier layer is at the same time designed as the "supporting" layer ("anti-ice-floe layer"), is essentially that no additional fabrication or printing step is necessary. On the other hand, the solution with the additional interlayer gives an additional degree of freedom for rational material selection for the dielectric barrier layer, especially in terms of the discharge-affecting dielectric as well as electrical properties.

For clearer understanding of the invention, the behaviour of the glass solders customarily used as a supporting glass layer for the porous layers will be explained first. Normally, hence also in the case of the Pb—B—Si—O glasses, the viscosity decreases as the temperature increases. This behaviour is reproducible as long as the temperature has not been so high that devitrification has already taken place. The term reproducible means that the temperature range in which the glass softens with defined viscosity is virtually constant even under repetition, i.e. in each case after corresponding prior cooling.

Conversely, the glass solders proposed according to the invention do not exhibit this behaviour. Instead, their viscosity variation as a function of temperature is irreversible. In this case, the viscosity does in fact decrease initially as the temperature increases.

Subsequently, however—even with further increasing temperature—an increase in viscosity once more takes place.

This variation in viscosity as a function of temperature is actually exhibited, in particular, by per se known crystallizing glass solders, the use of which as a layer arranged directly underneath the phosphor or reflective layer of the discharge lamp is proposed according to the invention. The aforementioned viscosity increase at constant or even increasing temperature is caused in crystallizing glass solders by the onset of the crystallization process. Using a defined temperature profile, the crystal growth as well as the phase composition and the crystallite size can also be controlled. The so-called sintered glass ceramic obtained in this way is distinguished in that, during a subsequent thermal treatment, it does not start to soften until higher temperatures, typically temperatures about 50–100° C. or more higher.

This meets the requirement of obtaining a "supportive" layer which is solid at the assembly temperature, i.e. more highly viscous, on which the porous layers can be printed. Through the use of such sintered glass ceramic layers, continuous reflective and/or phosphor layers are obtained, in particular after the assembly process. Bismuth borosilicate glass (Bi—B—Si—O) has proved to be a particularly suitable crystallizing glass solder. Examples of other suitable crystallizing glass solders include zinc bismuth borosilicate glass (Zn—Bi—B—Si—O) and zinc borosilicate glass (Zn—B—Si—O).

Good results have also been obtained with certain composite solders with similar viscosity/temperature behaviour.

DESCRIPTION OF THE DRAWINGS

The invention will be explained in more detail below with reference to several illustrative embodiments.

FIGS. 1*a*, 1*b* and 1*c* respectively show, in schematic representation, a plan view, a side view and a partial section along the line I—I of a flat phosphor lamp, which emits white light during operation. It is designed as back-lighting for an LCD (Liquid Crystal Display).

Figure 1A:
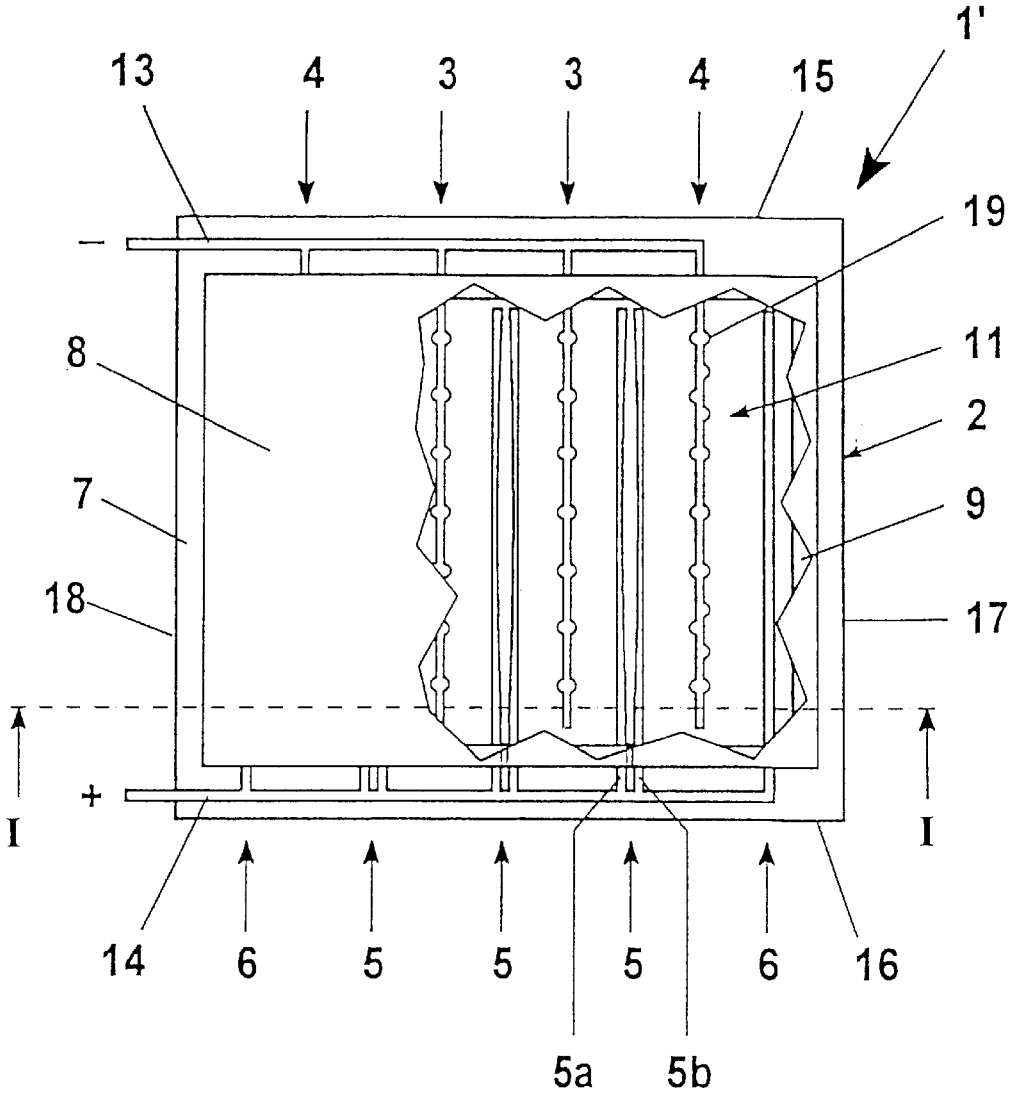
FIG. 1*a* shows a schematic representation of a partly cut-away plan view of a flat discharge lamp according to the invention with electrodes arranged on the baseplate.

The flat lamp 1 consists of a flat discharge vessel 2 with rectangular base surface, four strip-like metal cathodes 3, 4 (–) and anodes (+), of which three are designed as elongate double anodes 5 and two as single strip-like anodes 6. For its part, the discharge vessel 2 consists of a baseplate 7, a front plate 8 and a frame 9. The baseplate 7 and front plate 8 are respectively bonded hermetically to the frame 9 by means of the glass solder 10 so that the interior 11 of the discharge vessel 2 is of cuboid form. The baseplate 7 is larger than the front plate 8 so that the discharge vessel 2 has a free edge running around it. The cut-out in the front plate 8 serves only for illustration and gives a view of a part of the cathodes 3, 4 and anodes 5,6.

The cathodes 3, 4 and anodes 5,6 are arranged alternately and parallel on the inner wall of the baseplate 7. The anodes 6,5 and cathodes 3,4 are respectively extended at one of their ends and are fed out of the interior 11 of the discharge vessel 2 on both sides on the baseplate 7. On the edge of the baseplate 7, the electrode strips 3,4,5,6 each join the respective cathode-side 13 or anode-side 14 bus-like outer electricity supply. The two outer electricity supplies 13, 14 are used as contacts for connection to an electrical power source (not shown).

In the interior 11 of the discharge vessel 2, the electrodes 3–6 are fully covered with a sintered glass ceramic layer 61 of Bi—B—Si—O (cf. FIG. 1*c*), whose thickness is about 250 $\mu$m. On the one hand, this layer counteracts the "ice-floe formation". On the other, the sintered glass ceramic layer 61 acts at the same time as a dielectric barrier layer for all the electrodes 3–6. This is hence a case of bilateral dielectric impediment. A reflective layer 62 of $TiO_2$, whose thickness is about 4 $\mu$m, is applied on the sintered glass ceramic layer 61. On the reflective layer 62 in turn, and on the inner wall of the front plate 8, a phosphor blend layer 63 is applied (the layers are not represented in FIG. 1*a* for the sake of clarity; cf. FIG. 1*c*), which converts the UV/VUV radiation produced by the discharge to visible white light. This is a three-band phosphor with the blue component BAM ($BaMgAl_{10}O_{17}:Eu^{2+}$), the green component LAP ($LaPO_4$:[$Tb^{3+}$,$Ce^{3+}$]) and the red component YOB ([Y,Gd]$BO_3:Eu^{3+}$). The thickness of the phosphor blend layer 63 is about 30 $\mu$m.

The electrodes 3–6, including feed-throughs and outer electricity supplies 13, 14, are respectively designed as a continuous cathode-side or anode-side conductor-track layer-like structure. These two layer-like structures, as well as the other functional layers which follow—dielectric barrier layer 61, reflective layer 62 and phosphor layer 63—are applied directly on the baseplate 7 and front plate 8 by means of a screen printing technique.

After the layers 61–63 have been applied, the baseplate 7 is fused to the frame 9, and the latter is in turn fused to the front plate 8, in each case by means of glass solder 10, to form the complete flat lamp 1. The assembly process is carried out, for example, in a vacuum oven. Before the components of the discharge vessel are fused together, the interior 11 of the flat lamp 1 is filled with xenon at a filling pressure of 10 kPa. The two anode strips 5*a*, 5*b* of each anode pair 5 are widened in the direction of the two edges 15, 16 of the flat lamp 1, which are oriented perpendicular to the electrode strips 3–6, and to be precise asymmetrically exclusively in the direction of the respective partner strips 5*b* and 5*a*, respectively. The maximum distance between the two strips of each anode pair 5 is about 4 mm, and the smallest distance is about 3 mm. The two individual anode strips 6 are each arranged immediately next to the two edges 17, 18 of the flat lamp 1 which are parallel to the electrode strips 3–6.

The cathode strips 3; 4 have nose-like semicircular projections 19 facing the respective adjacent anode 5; 6. These cause locally limited amplifications of the electric field and consequently cause the delta-shaped individual discharges (not shown in FIG. 1*a*) created in operation according to WO94/23442 to be struck exclusively at these points. The distance between the projections 19 and the respective directly adjacent anode strip is about 6 mm. The radius of the semicircular projections 19 is about 2 mm.

Figure 1B:
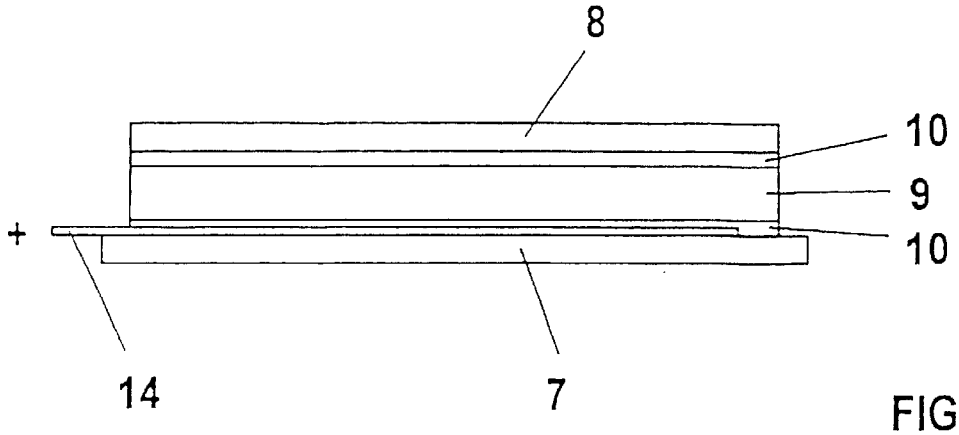
FIG. 1*b* shows a schematic representation of a side view of the flat lamp in FIG. 1*a,*
Figure 1C:
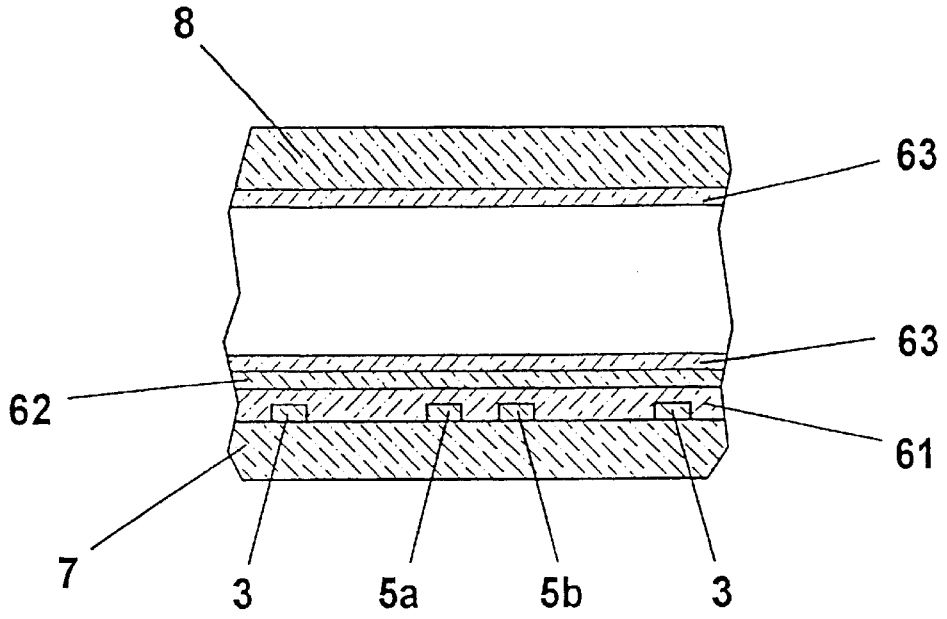
FIG. 1*c* shows a partial sectional representation of the flat lamp in FIG. 1*a* along the line I—I.
Figure 2:
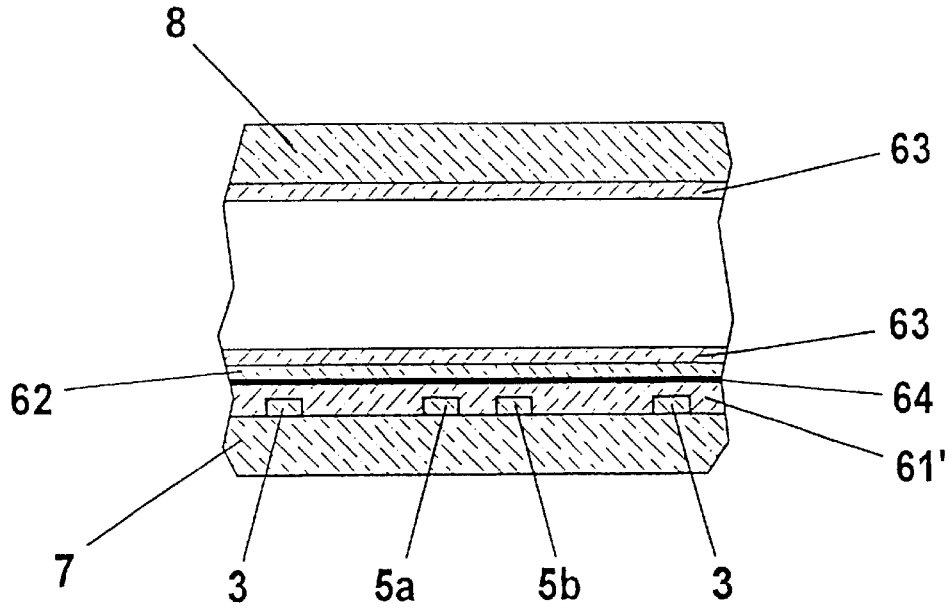
FIG. 2 shows a partial sectional representation of a variant of the flat lamp in FIG. 1*a* along the line I—I.

FIG. 2 shows a partial sectional representation of a variant of the flat lamp in FIG. 1*a* along the line I—I. The same features are given the same reference numbers. In contrast to the representation in FIG. 1*c*, an additional 12 $\mu$m thick interlayer 64 of Bi—B—Si—O is in this case arranged between the dielectric barrier layer 61' and the reflective layer 62. The dielectric barrier layer 61' consists here of lead borosilicate glass. The function of the crystallizing layer, which prevents the "ice-floe formation", is hence undertaken here by the interlayer 64.

In one variant (not shown), another reflective layer of $Al_2O_3$ is arranged between the $TiO_2$ layer and the phosphor layer. The reflecting effect is improved in this way.

The thickness of the $Al_2O_3$ layer is about 5 $\mu$m.

In the scope of the invention, yet further additional layers and layer arrangements are conceivable, without the advantageous effect of the invention being lost. All that is essential here is for that dielectric layer whose viscosity variation as a function of temperature is irreversible and hence prevents the "ice-flow formation" to be arranged directly underneath the phosphor or reflective layer ("supporting" layer).

At this point, it should again be pointed out that the layers represented very schematically in FIGS. 1*c* and 2 need not necessarily be extended over the entire surface of the baseplate. All that is essential is for at least the relevant electrode to be fully covered with the corresponding layers in each case. In the case of unilateral dielectric impediment, only the electrodes of one polarity, preferably the anodes, are covered with a "supporting" dielectric layer.

Furthermore, the individual layers need not necessarily be entirely plane, as represented in FIGS. 1*c* and 2 in a simplified manner. Instead, the individual layers, and in particular the very thin layers, may in practice also be inherently uneven. This is found especially when one or more layers are thinner than the electrodes and the layer(s) hence still recognizably reproduce the surface shape of the baseplate with the electrodes.

Another illustrative embodiment (not shown) involves a tubular aperture lamp. Apart from the different shape of the discharge vessel, the main difference from the flat lamp in FIG. 1 consists in the production process tailored to the modified vessel shape. In particular, the phosphor is in this case applied to the inner wall, or the functional layers previously arranged thereon, by applying a slurry. The principal sequence and function of the individual functional layers, in particular the inventive effect of the "supporting" layer which prevents the "ice-floe formation", correspond to those in FIG. 1.

What is claimed is:

1. Discharge lamp (1), suitable for operation by means of dielectrically impeded discharge, having a discharge vessel (2) at least partially consisting of an electrically non-conductive material, electrodes (3–6) which are arranged on the wall (7) of the discharge vessel (2), at least one dielectric layer (61; 64) which covers at least a part of the electrodes (3–6) and, optionally, the discharge vessel wall (7) as well, a phosphor (63) and/or reflective layer (62) which covers the at least one dielectric layer (61; 61, 64), characterized in that at least the dielectric layer (61; 64) arranged essentially directly underneath the phosphor or reflective layer (62) consists of a glass solder whose viscosity variation as a function of temperature is irreversible.

2. Discharge lamp according to claim 1, the softening temperature of the glass solder (61; 64) under repeated heating being more than about 25°C. higher than the softening temperature of the glass solder in the first melting process.

3. Discharge lamp according to claim 1 or 2, the glass solder (61; 64) consisting of a crystallizing glass solder (sintered glass ceramic).

4. Discharge lamp according to claim 3, the sintered glass ceramic (61; 64) consisting of Bi—B—Si—O.

5. Discharge lamp according to claim 1 or 2, the glass solder (61; 64) consisting of a composite glass solder.

* * * * *